US006787997B2

(12) United States Patent
Arai

(10) Patent No.: US 6,787,997 B2
(45) Date of Patent: Sep. 7, 2004

(54) LINEAR-BEAM MICROWAVE TUBE

(75) Inventor: Shintaro Arai, Tokyo (JP)

(73) Assignee: NEC Microwave Tube, Ltd., Sagamihara (JP)

( * ) Notice: Subject to any disclaimer, the term of this patent is extended or adjusted under 35 U.S.C. 154(b) by 0 days.

(21) Appl. No.: 10/300,821

(22) Filed: Nov. 21, 2002

(65) Prior Publication Data

US 2003/0098655 A1 May 29, 2003

(30) Foreign Application Priority Data

Nov. 28, 2001 (JP) ..... 2001-362854

(51) Int. Cl.[7] ..... H01J 23/02
(52) U.S. Cl. ..... 315/5.38; 315/5.39; 313/296
(58) Field of Search ..... 315/5, 5.38, 5.39, 315/5.37; 313/296, 293, 308; 330/44, 45

(56) References Cited

U.S. PATENT DOCUMENTS 6,060,832 A * 5/2000 Adler et al. ..... 315/5.38
6,127,779 A * 10/2000 True ..... 315/5
6,133,786 A * 10/2000 Symons ..... 315/5

FOREIGN PATENT DOCUMENTS

JP 07-045207 2/1995

* cited by examiner

*Primary Examiner*—James Vannucci
*Assistant Examiner*—Jimmy T. Vu
(74) *Attorney, Agent, or Firm*—McGinn & Gibb, PLLC

(57) ABSTRACT

A collector core of a microwave tube has an insulator and a radiator around a cylindrical outer peripheral portion thereof. The cylindrical insulator and radiator comprise a slit along a central axis of the collector core, respectively. These slits are arranged on mutually overlapped positions. Portions of the collector core corresponding to these slits are cut off so as to be flat or concave. These slits and the flat surface or the concave portion are arranged symmetrically in a section of the collector core.

22 Claims, 5 Drawing Sheets

LINEAR-BEAM MICROWAVE TUBE

BACKGROUND OF THE INVENTION

1. Field of the Invention

The present invention relates to a linear-beam microwave tube, and more in particular, to a collector structure of the linear-beam microwave tube.

2. Description of the Related Prior Art

A linear-beam microwave tube for high power has a collector core for collecting electrons of electron beams, which turns into high temperatures and high voltages during its operation. Hence, the collector core comprises a cylindrical insulator made of ceramic around an outer peripheral portion thereof, and comprises further a radiator for heat sink around an outer peripheral portion of the insulator. FIG. 1A is a longitudinal sectional view of a conventional linear-beam microwave tube, and FIG. 1B is a transverse sectional view cut along the line B—B of FIG. 1A. A collector section 1 is connected to a high frequency circuit portion 2, which guides electron beams emitted from a beam emission source (not shown), and comprises a collector core 4 for collecting electrons of electron beams and a vacuum holding insulator 5 for holding a vacuum state inside the collector section 1. The cylindrical insulator 6 made of ceramic is arranged by adhering on the outer peripheral portion of the cylindrical portion of the collector core 4, and, further, the cylindrical radiator 7 made of metal is arranged by adhering on the insulator 6. The collector section 1 transmits the heat generated by the collector core 4 to the radiator through the insulator 6 made of ceramic. However, though the ceramic material is a good material to boost a withstand voltage, a heat conductivity thereof is small comparing to metal. Therefore, the heat generated by the collector core 4 is not necessarily transmitted efficiently to the radiator 7.

Japanese Patent Laid-Opened No. 7-045207 discloses a collector core comprising an insulator made of ceramic in which a slit is formed so as to enhance radiation effect. While, in the case of a conventional collector core shown in FIG. 2, the insulator 6 and the radiator 7 comprise the slit, respectively. It is, therefore, possible for the collector core 4 to radiate the generated heat directly outside, and the radiation effect of the collector core 4 can be enhanced much more. However, the collector core of the microwave tube is usually formed by metal such as, for example, copper, and the radiator is also formed by metal, and consequently, an electric discharge tends to develop between the collector core and the radiator with a result that a withstanding voltage characteristic is deteriorated.

SUMMARY OF THE INVENTION

The present invention has been made in view of the foregoing disadvantages of the prior art.

Accordingly, it is an object of the present invention to provide a microwave tube having a collector core, which comprises high withstand voltage and high radiation characteristics.

The linear-beam microwave tube according to the present invention comprises a collector core, an insulator and a radiator. The insulator is arranged on an outer peripheral portion of the collector core and comprises a slit. Also, the radiator is arranged on an outer peripheral portion of the insulator, and comprises a slit on the portion corresponding to the above-described slit. The collector core is cut off at a portion, which corresponds to these two slits.

In one preferred embodiment of the present invention, the cut-off portion of the collector core is flat.

In another preferred embodiment of the present invention, the cut-off portion of the collector core is concave.

BRIEF DESCRIPTION OF THE DRAWINGS

The above and other objects, features and advantages of the present invention will become apparent from the following detailed description when taken with the accompanying drawings in which.

DETAILED DESCRIPTION OF THE PREFERRED EMBODIMENTS

Now, a linear-beam microwave tube according to the present invention will be described in detail with reference to the accompanying drawings.

Figure 1A:
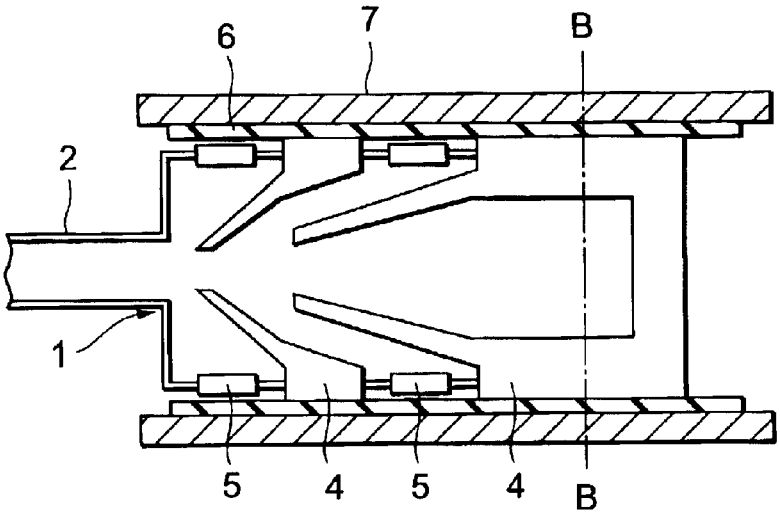
FIG. 1A (PRIOR ART)
FIGS. 1A, 1B are longitudinal sectional and transverse sectional views of a collector section of a conventional linear-beam microwave tube, respectively.
Figure 1B:
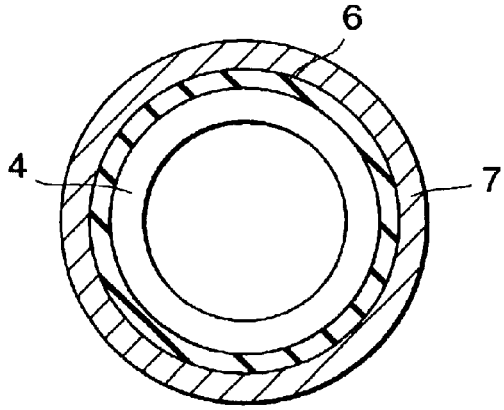
FIG. 1B (PRIOR ART)
Figure 2:
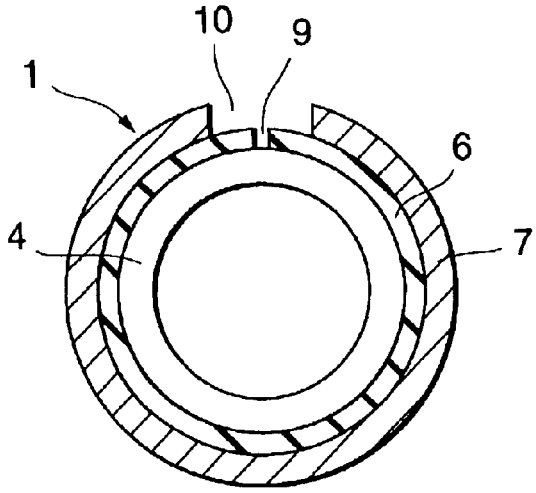
FIG. 2 (PRIOR ART)
FIG. 2 is a transverse sectional view of the collector section of the conventional linear-beam microwave tube.
Figure 3A:
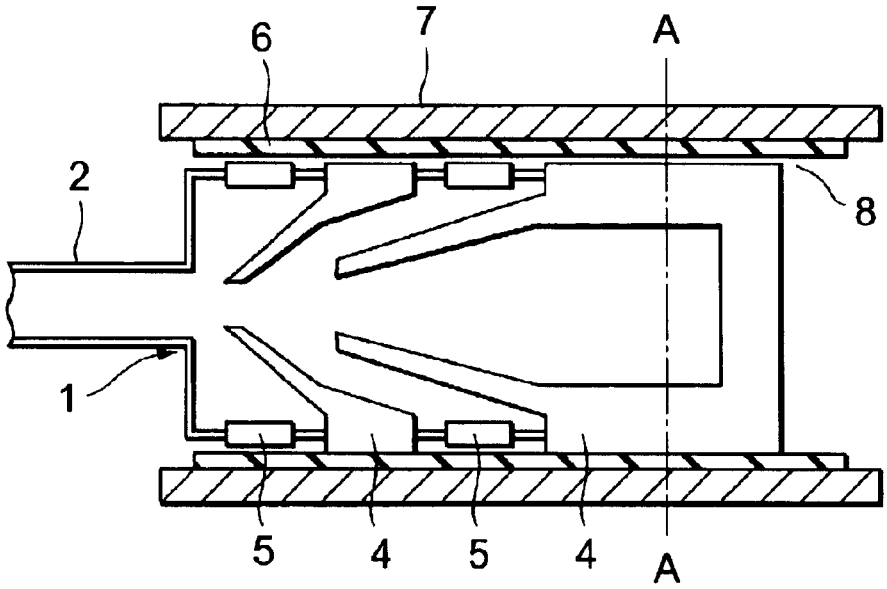
FIGS. 3A, 3B are longitudinal sectional and transversal sectional views of the collector section of the linear-beam microwave tube of an embodiment of the present invention, respectively.
Figure 3B:
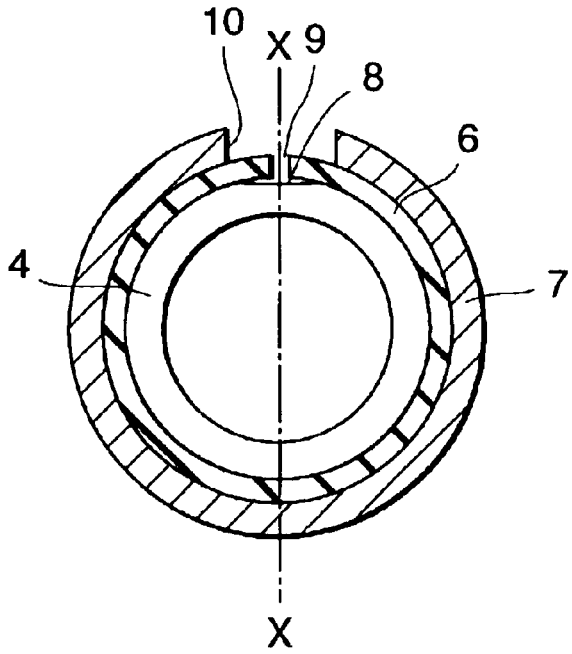

FIGS. 3A, 3B are sectional views of one portion of the linear-beam microwave tube according to an embodiment of the present invention. FIG. 3A shows a section cut along the line X—X of FIG. 3B, and FIG. 3B shows a section cut along the line A—A of FIG. 3A.

In the drawings, the linear-beam microwave tube comprises a collector section 1, an insulator 6 and a radiator 7. The collector section 1 is connected to a high frequency circuit portion 2. The high frequency circuit portion 2 guides electron beams emitted from a beam emission source (not shown). The collector section 1 comprises a collector core 4 for collecting electrons of the electron beams and a vacuum holding insulator 5 for holding a vacuum state inside the collector section 1. The collector section 1 comprises two pieces of the collector core 4. The collector core 4 has a cylindrical main body. The cylindrical insulator 6 is arranged on an outer peripheral portion of the main body of the collector core 4. Further, the cylindrical radiator 7 is arranged on an outer peripheral portion of the insulator 6. The collector core 4, the insulator 6 and the radiator 7 are closely contacted with one another. The collector core 4 is formed by metal or graphite, and the insulator 6 is made of ceramic, and the radiator 7 is made of metal.

The cylindrical insulator 6 comprises a slit 9, which is formed along a central axis of the collector core 4. Further, the radiator 7 comprises a slit 10 having a width larger than that of the slit 9 at a position, which overlaps the slit 9. A portion of the collector core 4, which corresponds to these two slits 9, 10, is cut off so as to form a flat surface portion 8. In this illustrated embodiment as shown in FIG. 3B, the flat surface portion 8, the slit 9 and the slit 10 are arranged in such a manner that respective centers thereof overlap along a radial direction of the main body of the collector core 4. That is, the flat surface portion 8 and the slits 9, 10 are arranged symmetrically. The small collector core 4 at the left side as shown in FIG. 3A has also a section as shown in FIG. 3B.

Figure 4:
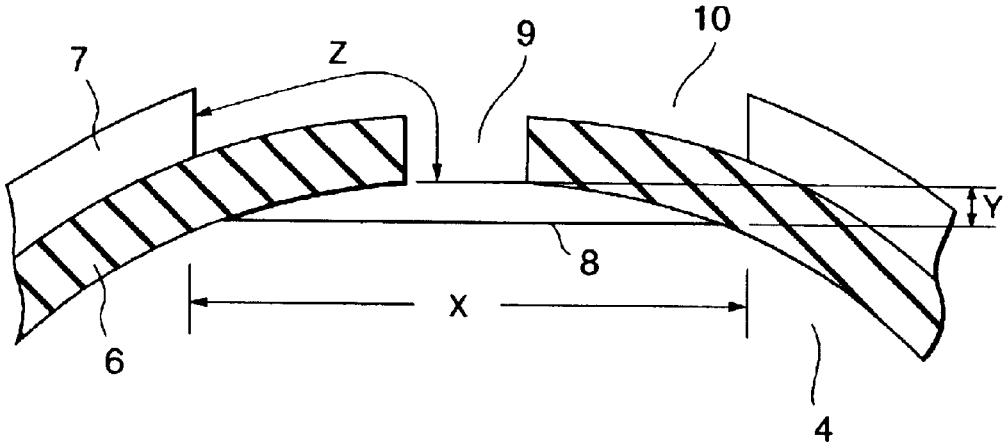
FIG. 4 is a partially enlarged view of the collector section of the embodiment of FIG. 3B of the present invention.

FIG. 4 is a partially enlarged view of FIG. 3B. In this drawing, reference character X denotes a width of the flat surface portion 8 of the collector core 4, reference character Y denotes the shortest distance between a lower end portion of the end surface of the slit 9 of the insulator 6 and the flat surface portion 8, and reference character Z denotes the distance between the end surface of the slit 10 of the radiator 7 and the lower end portion of the end surface of the slit 9 of the insulator 6. The heat generated in the collector core 4 is transmitted to the radiator 7 through the insulator 6. When the width X of the flat surface portion 8 becomes larger, an area whereby the collector core 4 contacts the insulator 6 becomes smaller. As a result, radiation characteristic based on heat conduction is deteriorated. When the width X of the flat surface portion 8 becomes smaller, a distance (Y–Z) between the flat surface portion 8 and the radiator 7 becomes shorter. As a result, an electric discharge tends to develop between the flat surface portion 8 of the collector core 4 and the radiator 7, and the withstand voltage characteristic is deteriorated. The width of the slit 9 of the insulator 6 is narrower than the width of the slit 10 of the radiator 7. This is because the distance (Y–Z) between the flat surface portion 8 of the collector core 4 and the radiator 7 is made long so as to boost the withstand voltage. In order to boost the radiation characteristic by radiation of the collector core 4, it is desirable to enlarge the width of the slit 9 of the insulator 6. However, by so doing, there is the possibility of the withstand voltage characteristic becoming deteriorated.

As described above, when the radiation characteristic and the withstand voltage characteristic are taken into consideration, it is practically most desirable that the flat surface portion 8 and the slits 9, 10 are arranged in such a manner that Z:Y is almost 5:1. In this illustrated embodiment, an outer diameter of a cylindrical portion of the collector core 4 is within the range of 10 mm to 100 mm, similarly the thickness of the cylindrical portion is within the range of 0.5 mm to 50 mm, the thickness of the insulator 6 is within the range of 1 mm to 50 mm, and the thickness of the radiator 7 is within the range of 1 mm to 50 mm, respectively. Note that it is possible for the collector section 1 to have one collector core, and also have not less than three collector cores. In these cases also, each collector core comprises the above-described flat surface portion 8.

Figure 5:
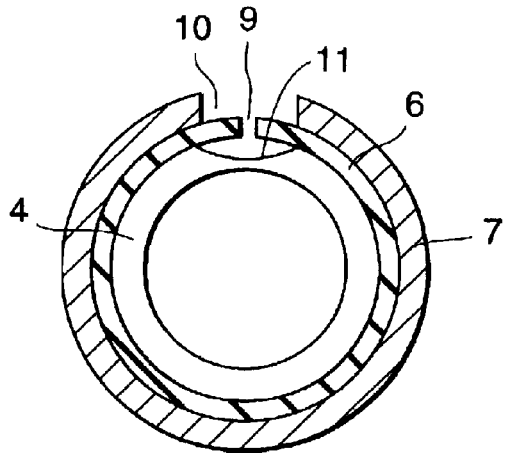
FIG. 5 is a transverse sectional view of the collector section of the linear-beam microwave tube of another embodiment of the present invention.
Figure 6:
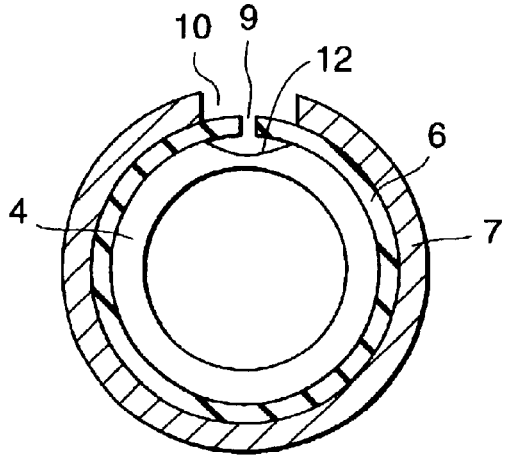
FIG. 6 is a transverse sectional view of the collector section of the linear-beam microwave tube of still another embodiment of the present invention.
Figure 7:
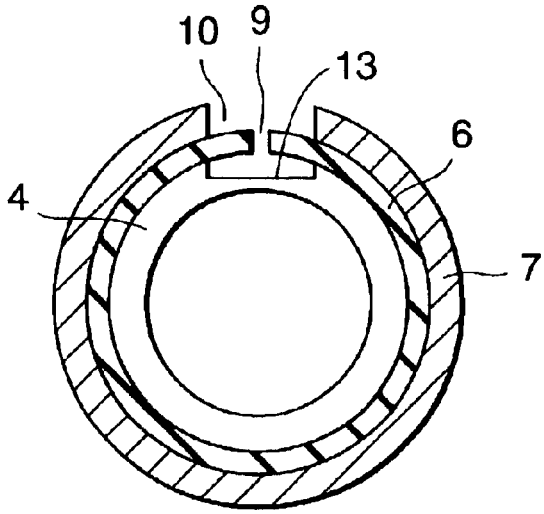
FIG. 7 is a transverse sectional view of the collector section of the linear-beam microwave tube of still a further embodiment of the present invention.

FIG. 5 shows another illustrated embodiment of the collector core. As shown in FIG. 3B, the portions of the collector core, which correspond to the slits 9, 10, are partially cut off. The section of the portion thus cut off has an arc-shaped concave portion. FIG. 6 shows still another illustrated embodiment of the collector core. In this illustrated embodiment, the section of the cut-off portion of the collector core has a V-shaped concave portion. FIG. 7 shows still a further illustrated embodiment of the collector core. In this illustrated embodiment, the section of the cut-off portion of the collector core has a box-shaped form. The collector cores shown in FIGS. 5, 6, 7 can enhance the withstand voltage characteristic.

While the present invention has been described in connection with certain preferred embodiments, it is to be understood that the subject matter encompassed by the present invention is not limited to those specific embodiments. On the contrary, it is intended to include all alternatives, modifications, and equivalents as can be included within the spirit and scope of the following claims.

What is claimed is:

1. A linear-beam microwave tube comprising:

a collector core for collecting electrons of electron beams;

an insulator which is arranged by adhering on an outer peripheral portion of said collector core and which comprises a slit; and a radiator which is arranged by adhering on the outer peripheral portion of the insulator and which comprises a slit in a portion corresponding to the slit of said insulator;

wherein said collector core comprises a cut-off portion, which corresponds to said two slits.

2. The linear-beam microwave tube according to claim 1, wherein the cut-off portion of said collector core comprises a flat portion.

3. The linear-beam microwave tube according to claim 1, wherein the cut-off portion of said collector core comprises a concave portion.

4. The linear-beam microwave tube according to claim 3, wherein the cut-off portion of said collector core comprises a circular arc portion.

5. The linear-beam microwave tube according to claim 3, wherein the cut-off portion of said collector core comprises a V-shaped portion.

6. The linear-beam microwave tube according to claim 3, wherein the cut-off portion of said collector core comprises a box-shaped portion.

7. The linear-beam microwave tube according to claim 1, wherein a width of the slit of said insulator is smaller than the width of the cut-off portion of said collector core.

8. The linear-beam microwave tube according to claim 1, wherein the width of the slit of said radiator is larger than the width of the slit of said insulator.

9. The linear-beam microwave tube according to claim 1, wherein the width of the slit of said radiator has the same width as the width of the cut-off portion of said collector core.

10. The linear-beam microwave tube according to claim 1, wherein the slit of said radiator, the slit of said insulator and the cut-off portion of the collector core are arranged symmetrically in a section of the collector core.

11. The linear-beam microwave tube according to claim 1, wherein a distance from a lower end of the end surface of the slit of said insulator to the end surface of the slit of said radiator is about five times the distance from said lower end to said collector core.

12. The linear-beam microwave tube according to claim 1, wherein a ratio of a distance between an end surface of said slit in said radiator and a lower end portion of the slit in said insulator, and a shortest distance between a lower end portion of the end surface of the slit in the insulator and the cut-off portion of the collector core, is 5:1.

13. The linear-beam microwave tube according to claim 1, wherein said collector core comprises one of a metal and a graphite, said insulator comprises a ceramic material and said radiator comprises a metal.

14. The linear-beam microwave tube according to claim 1, wherein a gap is formed between the collector core and the insulator in an area of said slit in said insulator.

15. The linear-beam microwave tube according to claim 1, wherein an outer diameter of said collector core is in a range from 10 mm to 100 mm.

16. The linear-beam microwave tube according to claim 1, wherein a thickness of said collector core is in a range from 0.5 mm to 50 mm.

17. The linear-beam microwave tube according to claim 1, wherein a thickness of said insulator is in a range from 1 mm to 50 mm.

18. The linear-beam microwave tube according to claim 1, wherein a thickness of said radiator is in a range from 1 mm to 50 mm.

19. The linear-beam microwave tube according to claim 1, wherein said collector core comprises a plurality of collector cores.

20. The linear-beam microwave tube according to claim 1, wherein said cut-off portion is formed in an outer surface of said collector core, and extends in an axial direction along the length of said collector core.

21. The linear-beam microwave tube according to claim 1, wherein said slit in said insulator extends in an axial direction along the length of said insulator, and wherein said slit in said radiator extends in an axial direction along the length of said radiator.

22. A linear-beam microwave tube comprising:

a collector core for collecting electrons of electron beams;

an insulator formed on an outer surface of said collector core and comprising a first slit; and a radiator formed on an outer surface of the insulator and comprising a second slit in an area of said first slit, wherein said collector core comprises an irregular portion in an area of said first and second slits.

* * * * *